United States Patent [19]

Pinto et al.

[11] Patent Number: 4,694,538

[45] Date of Patent: Sep. 22, 1987

[54] FEED APPARATUS FOR CARDS, CARDING ENGINES, AND THE LIKE

[75] Inventors: Akiva Pinto, Gastonia, N.C.; Guenter Lucassen, Haltern, Fed. Rep. of Germany

[73] Assignee: Hergeth Hollingsworth GmbH, Duelmen, Fed. Rep. of Germany

[21] Appl. No.: 858,626

[22] Filed: May 2, 1986

Related U.S. Application Data

[63] Continuation of Ser. No. 657,844, Oct. 4, 1984, abandoned.

[30] Foreign Application Priority Data

Oct. 8, 1983 [DE] Fed. Rep. of Germany ..... 3336654

[51] Int. Cl.[4] ..... D01G 15/40

[52] U.S. Cl. ..... 19/105; 19/300

[58] Field of Search ..... 19/105, 106 R, 296, 19/300, 301, 97.5

[56] References Cited

U.S. PATENT DOCUMENTS

| | | | |
|---|---|---|---|
| 3,070,847 | 1/1963 | Schwab | 19/105 |
| 4,009,803 | 3/1977 | Lytton et al. | 19/105 X |
| 4,321,732 | 3/1982 | Erben | 19/105 X |
| 4,387,486 | 6/1983 | Keller et al. | 19/105 |
| 4,404,710 | 9/1983 | Wood | 19/300 X |
| 4,476,611 | 10/1984 | Keller et al. | 19/105 |
| 4,486,921 | 12/1984 | Leifeld | 19/105 |
| 4,523,351 | 6/1985 | Leifeld | 19/105 |

FOREIGN PATENT DOCUMENTS 1457312 12/1975 United Kingdom .

*Primary Examiner*—Werner H. Schroeder
*Assistant Examiner*—Judith L. Olds
*Attorney, Agent, or Firm*—Cort Flint

[57] ABSTRACT

In a chute feed apparatus for carding engines, cards and like machines, there is disclosed means for changing the widthwise configuration of sheet material being fed and exiting the apparatus by changing the deformation of a constituent wall of the delivery chute shaftway. This wall has a deformable member and displacement devices and holding members which deform the wall's shaftway contours responsive to the density or thickness of the sheet material exiting so as to provide sheet material with a desired contour widthwise.

9 Claims, 6 Drawing Figures

FEED APPARATUS FOR CARDS, CARDING ENGINES, AND THE LIKE

CROSS REFERENCE TO RELATED APPLICATION

Figure 1:
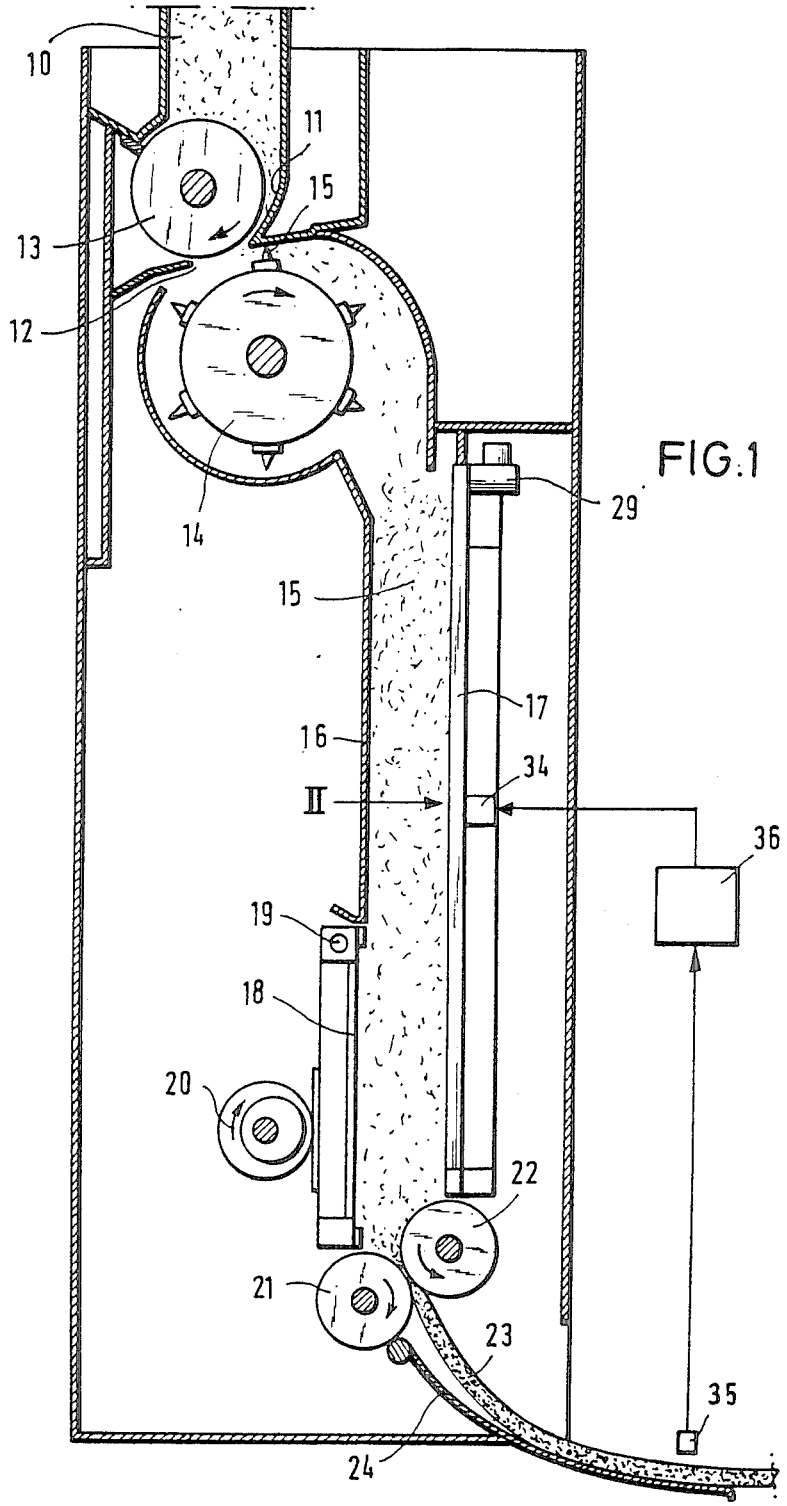

This application is a continuation of application Ser. No. 657,844 entitled Feed Apparatus For Cards, Carding Engines and the Like, filed Oct. 4, 1984, which is now abandoned.

The invention relates to a feed apparatus for cards, carding engines, and the like, with a substantially vertical shaft bounded by two sidewalls.

In such feed apparatuses, a loose fiber material is filled into a shaft of rectangular cross section, where a loose stack of tuft-like textile fiber material is formed. The fiber stack is pulled out of the shaft, while being compressed, by a takeoff roll pair located at the bottom end of the shaft, and is fed via a guide plate or chute to a textile processing machine, e.g., a card or carding engine. The distribution of fiber material in the shaft is disordered, so that an irregular and random distribution of material over the width of the shaft can result. This leads to the sheet of material fed to the further processing machine having variable weight across its width. As a rule, it is desired to obtain a sheet of fiber material of uniform thickness or density. However, in some cases a non-uniform distribution of material is desired, e.g., a higher density of material in the edge regions and a lower density of material in the middle region, or vice versa. The known feed apparatuses do not permit the cross sectional profile of the fiber material sheet produced to be altered and matched to the respective needs and requirements.

The object of the present invention is to create a feed apparatus of the kind mentioned at the beginning, by means of which apparatus it is possible to alter the distribution of the fiber material over the width of the sheet.

To achieve this object, it is provided according to the invention that one of the sidewalls of the shaft is deformable in the direction of the shaft width and that the deformable sidewall is fastened, by holding elements which are displaceable transversely of the shaft, to a rigid carrying part.

By "width" is to be understood, here and in the following, that direction in which the sidewalls of the shaft extend and which corresponds to the width of the sheet of fiber material to be produced. The shaft width is thus to be distinguished from the "breadth" of the shaft, which is determined by the mutual spacing of the sidewalls and is measured parallel to the end walls of the shaft.

Since one of the sidewalls of the shaft can be altered in shape, the open cross sectional profile of the shaft can be altered. Hence it is possible to form the cross sectional shape of the shaft such that there results a desired distribution of the fiber material over the shaft width or over the width of the fiber material sheet to be produced. Deviations from the uniformity of the density of material can thus be corrected. For example, it is possible for the density of material to decrease towards the end walls of the shaft. If now a sheet of fiber material of uniform density is to be produced, the deformable sidewall can be deformed in its middle region so that it forms a bulge projecting into the shaft. A thinner layer, with higher density, arises in the region of the bulge, and thicker layers of lower material density arise in the edge regions. These distributions of thickness and material density result after the passage of a sheet of material, of uniform distribution of material over the width, through the takeoff rolls.

On the other hand, it may be desired to obtain, in the middle region of the fiber material sheet to be produced, a density of material which is substantially greater than the density of material at the edges. For this purpose, the sidewall can be deformed such that it is drawn back in the middle region of the shaft, so that the shaft has a greater width in this region than in the edge regions.

The deformable sidewall can consist of a plate which is fixed at both ends and can be curved in the middle. Such a plate can be curved convexly towards, or concavely away from, the shaft cavity, or held fast as a planar surface. The plate can consist, for example, of a flexible metal sheet. The above embodiment has the advantage that the shape of the sidewall can be determined and varied with relatively few holding elements. Shape changes can be carried out by adjusting a minimum number of holding elements.

According to another variant of the invention, it is provided that the deformable sidewall has a flexible web having stiffening elements attached to its rear side and engaged by the holding elements. By corresponding adjustment of the flexible web, not only can different curvatures be obtained, but also the deformable wall can be brought into any optional profile configuration.

The stiffening elements are preferably longitudinal rails which extend substantially over the whole height of the deformable sidewall.

Examples of embodiments of the invention are explained in detail below with reference to the drawings.

Figure 3:
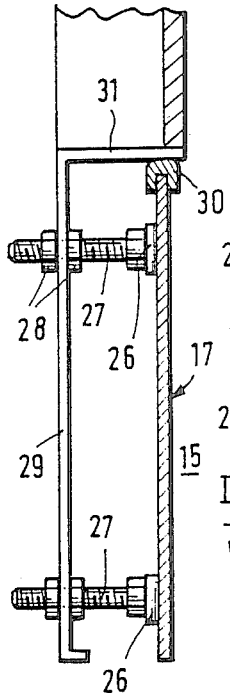
Figure 2:
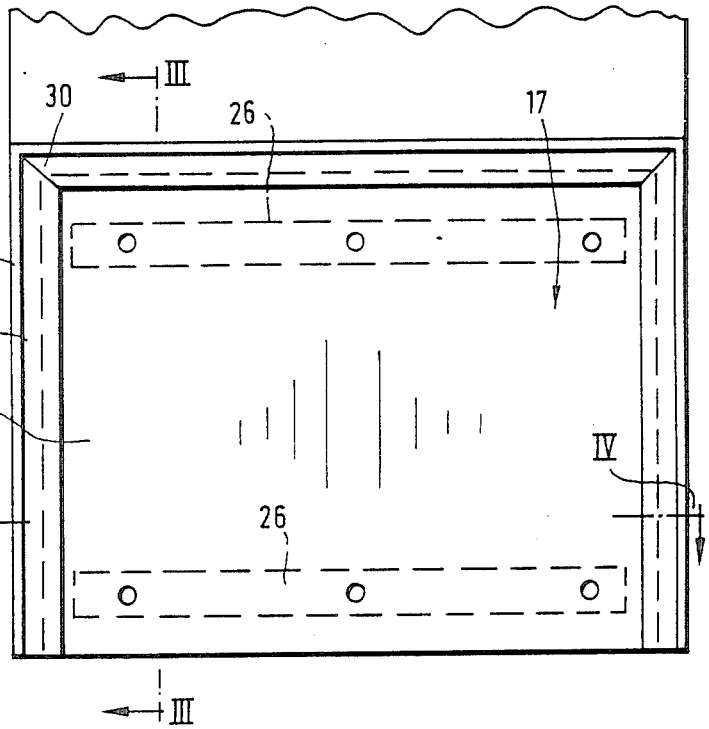
Figure 4:
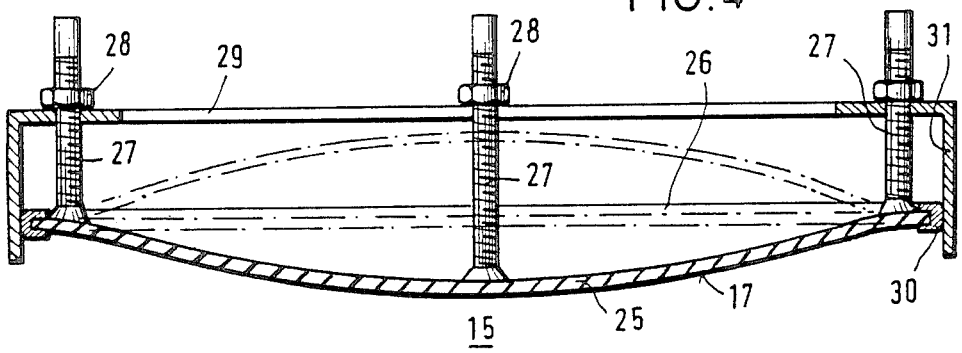
Figure 5:
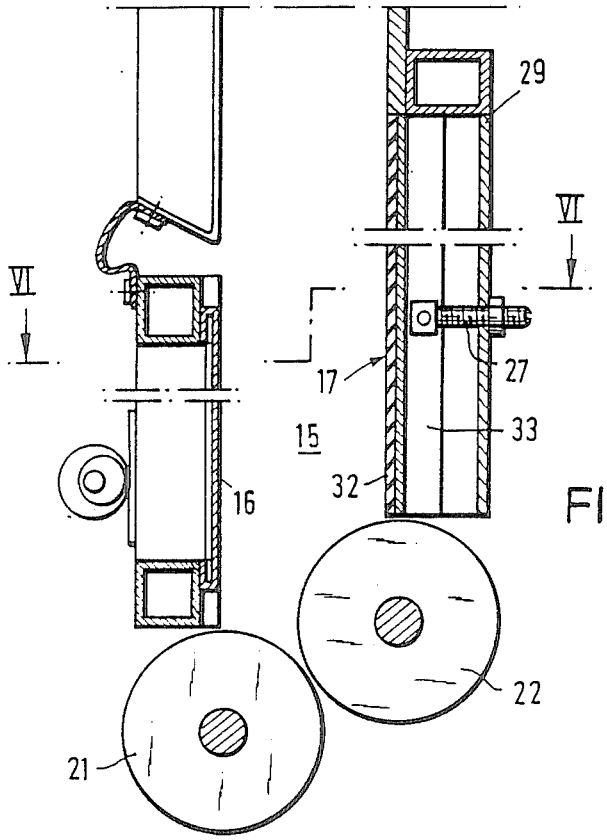
Figure 6:
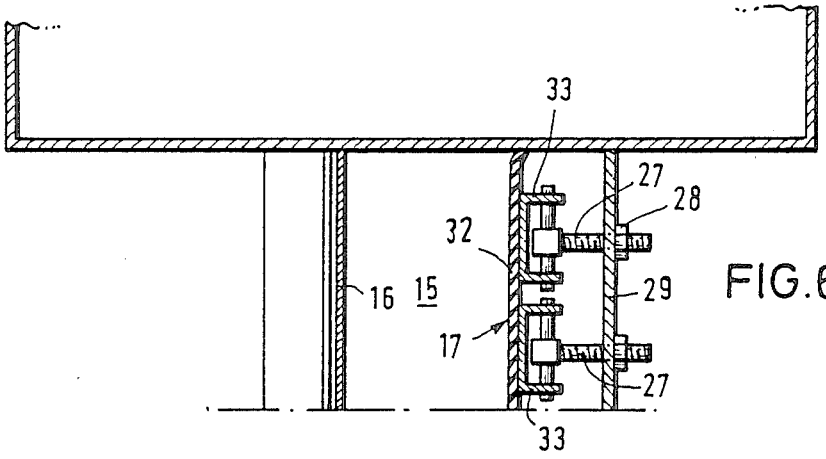

There are shown in:

FIG. 1 a schematic cross sectional representation of a feed apparatus,

FIG. 2 a view of a deformable sidewall from the direction of the arrow II in FIG. 1, FIG. 3 a section along the line III—III of FIG. 2, FIG. 4 a section along the line IV—IV of FIG. 2, FIG. 5 a section through the shaft with a second embodiment of the adjustable wall, and FIG. 6 a section along the line VI—VI of FIG. 5.

In the feed apparatus shown in FIG. 1, fibrous textile material in the form of flocks is passed via a vertical shaft 10 into a feed trough 11 which has an opening 12 in its floor. In the trough 11 is located a rotating feed roll 13, which has tooth-like projections on its peripheral surface to entrain fiber material.

A rotating beater roll 14 is located below the opening 12 and has beater bars 15 which stand out radially and which grip and entrain the fiber material in the region of the opening 12. The fiber material combed out and entrained by the beater roll 14 from the opening 12 arrives in a vertical shaft 15, which projects downwards, approximately tangentially, from the ejection end of the beater roll 14. The shaft 15 has a stationary, plane-surfaced sidewall 16 and a deformable sidewall 17 which is still to be described. The deformable sidewall 17 is located at the side facing outwards, so that it is easily accessible for carrying out adjustments.

The lower region of the stationary wall 16 is constructed as a shaker wall 18. This shaker wall 18 is suspended on a horizontal axle and is pivoted back and forth in the direction of the interior of the shaft 15 by a driven eccentric 20, in order to compress the fiber material in the shaft by shaking.

A takeoff roll pair, consisting of contra-rotating rolls 21 and 22 extending over the whole width of the shaft 15, is located at the lower end of the shaft 15. The fiber material is temporarily compressed between the rolls 21 and 22, and is drawn off from the lower end of the shaft. The resulting fiber sheet slides on a slide surface 24 in order to be fed to a further processing machine.

The deformable sidewall consists, according to FIGS. 2, 3 and 4, of a flexible plate 25, which can assume the shape of a concave or convex curvature. Flexible bars 26 are attached to the rear side of the plate 25 near the upper and lower ends, and the holding elements 27, in the form of screw bolts, stand out from them in the outward direction. These holding elements 27 carry nuts 28 which are supported on a rigid frame forming the carrying part 29. The effective lengths of the holding elements 27 can be altered by displacing the nuts 28 on the screw bolts. According to FIG. 4, carrying part 29 has threaded bores in which the threads of the threaded bolts 27 engage. Because of this, only a single respective counter-nut 28 is used here for fixing the set length of a holding element 27. Three different shapes are shown in FIG. 4; they can be assumed by the deformable wall 17 by adjustment of the effective length of the middle holding elements 27 without the two outer edge holding elements 27 being adjusted. It can be seen that the deformable wall 17 can assume a concave, convex, or planar shape with respect to the shaft 15; all the intermediate positions between those shown in the drawing are also possible. Finally, the width of the shaft can also be altered by adjusting the outer holding elements 27.

The plate 25 has edge seals 30 around three edges. The seals cooperate with projecting flanges 31 of the stationary, rigid frame forming the carrier part 29, in order to prevent fiber material passing behind the plate 25.

In the example of an embodiment shown in FIGS. 5 and 6, the deformable wall 17 consists of a flexible sheet 32 which has stiffening elements on its rear side in the form of longitudinal vertical rails 33. The rails 33 are arranged spaced apart side by side across the width, and they can be adjusted, relative to the stationary, rigid support part 29, by displacement of the holding elements 27 into the interior of the shaft 15 and in the opposite direction. Each of the U-shaped rails 33 can be individually adjusted in relation to the rigid carrier part 29 in this manner, in order to obtain a desired overall course of the flexible sheet 32 which bounds the shaft 15.

The adjustment of the deformable sidewalls 17 can also take place by driven adjusting devices 34 (FIG. 1), which are driven by auxiliary power and are either manually controlled or are integrated into a control device. In FIG. 1, several thickness sensors 35 are arranged above the slide surface 24, distributed over the width of the fiber sheet 23, and measuring the thickness or density of the fiber sheet 23 at different positions across the width. The signals of the thickness sensors 35 are fed to a controller 36 which sets the adjusting devices 34 such that the desired thickness of the sheet 23 of material is maintained, and so that if necessary a predetermined thickness profile of this sheet of material is also maintained. Thus by means of the adjusting devices 34 not only can the shaft profile be altered, but also the deformable wall can be displaced as a whole, so that the shaft width is altered while the profile of this wall 17 remains the same.

We claim:

1. Feed apparatus for cards, carding engines and the like, including a substantially vertical shaftway defined at least in part by two side walls and two end wall flanges, the improvement comprising:

one of said side walls being formed of a resilient deformable member which is deformable in the widthwise direction of said vertical shaftway thereby enabling the distance between the two side walls to vary along the widthwise direction of said vertical shaftway, wherein said one side wall is fastened to a carrying part by holding means by which said deformable member is displaceable transversely of said shaftway; and edge seal means carried by opposing edges of said deformable member contacting with said end wall flanges in a manner that said opposing edges may move in sliding contact with said wall flanges when said deformable member is displaced transversely.

2. Feed apparatus according to claim 1, wherein said deformable member comprises a plate having opposing ends which is held fast at said ends and said plate may be deformed to be curved in the middle.

3. Feed apparatus according to claim 1, wherein said holding means includes holding elements which are displaceable transversely of said shaftway and said deformable member has a flexible web having an outer side with stiffening elements attached to said outer side engageable with said holding elements.

4. Feed apparatus according to claim 3, wherein said stiffening elements are elongated rails disposed to extend substantially over the entire vertical length of said deformable member.

5. Feed apparatus according to claim 1, wherein said holding means includes holding elements which are displaceable transversely of said shaftway and said deformable member is carried by said displaceable holding elements, and said apparatus further includes displacement devices interconnected with said holding elements for control of the amount of displacement thereof.

6. Feed apparatus according to claim 5, wherein said displacement devices are controllable by auxiliary power means.

7. Feed apparatus according to claim 6, wherein said auxiliary power means is interconnected with sensing means for sensing the density thickness of sheet material exiting said vertical shaftway in a manner whereby said auxiliary power means controls said displacement devices to deform said deformable member in proportion to a signal received from said sensing means by said auxiliary power means.

8. The apparatus of claim 1 including flexible bar means carried by said deformable member and connected to said holding means in a manner that said bar means may flex concavely or convexly to transversely displace said deformable member correspondingly.

9. The apparatus of claim 8 wherein said holding means includes an adjusting element carried approximately midway of the width of said shaftway for adjusting said flexible bar to said concave or convex configuration.

* * * * *